US007893951B2

(12) United States Patent
Narui et al.

(10) Patent No.: US 7,893,951 B2
(45) Date of Patent: Feb. 22, 2011

(54) IMAGE DISPLAY APPARATUS AND IMAGE DISPLAY METHOD

(75) Inventors: Yoshihisa Narui, Saitama (JP); Toshiro Kojima, Kanagawa (JP); Hiroshi Nakano, Kanagawa (JP); Yasutake Furukoshi, Kanagawa (JP); Kikuo Kotake, Kanagawa (JP)

(73) Assignee: Sony Corporation (JP)

( * ) Notice: Subject to any disclaimer, the term of this patent is extended or adjusted under 35 U.S.C. 154(b) by 677 days.

(21) Appl. No.: 11/714,708

(22) Filed: Mar. 6, 2007

(65) Prior Publication Data

US 2007/0216669 A1 Sep. 20, 2007

(30) Foreign Application Priority Data

Mar. 8, 2006 (JP) ..... P2006-062992

(51) Int. Cl.
*G09G 5/02* (2006.01)

(52) U.S. Cl. ..... 345/698; 345/204

(58) Field of Classification Search ..... 345/3.1, 345/3.2, 3.3, 3.4, 520, 87–104, 204–215, 345/690–699

See application file for complete search history.

(56) References Cited

U.S. PATENT DOCUMENTS 5,943,029 A * 8/1999 Ross ..... 345/11
6,392,642 B1 * 5/2002 Wu ..... 345/213
7,050,770 B1 * 5/2006 Hutton et al. ..... 455/126
7,366,886 B2 * 4/2008 Yoo ..... 713/1
7,372,457 B2 * 5/2008 Wang ..... 345/204
2002/0188770 A1 * 12/2002 Kehlet ..... 710/8
2006/0017751 A1 * 1/2006 Shintani et al. ..... 345/698
2006/0114275 A1 * 6/2006 Kim et al. ..... 345/698
2007/0063940 A1 * 3/2007 Juenger ..... 345/87

FOREIGN PATENT DOCUMENTS

JP 2001-265313 A 9/2001
JP 2005-099841 A 4/2005

* cited by examiner

*Primary Examiner*—Amare Mengistu
*Assistant Examiner*—Dmitriy Bolotin
(74) *Attorney, Agent, or Firm*—Lerner, David, Littenberg, Krumholz & Mentlik, LLP

(57) ABSTRACT

Disclosed herein is an information display apparatus for displaying an image received from an image supplying source on an image display section after carrying out a conversion process on the image in an image conversion section employed in the information display apparatus on demand. The information display apparatus may include a timing storage section, an image determination section, and an output-path switching section.

6 Claims, 9 Drawing Sheets

IMAGE DISPLAY APPARATUS AND IMAGE DISPLAY METHOD

CROSS-REFERENCE TO RELATED APPLICATIONS

The present application claims priority from Japanese Patent Application No. JP 2006-062992, filed in the Japanese Patent Office on Mar. 8, 2006, the entire content of which is incorporated herein by reference.

BACKGROUND OF THE INVENTION

1. Field of the Invention

The present invention relates to an image display apparatus and an image display method, which are used for displaying an image based on image data received typically from an image supplier.

2. Description of the Related Art

There has been provided a standard named a DDC (Display Data Channel) standard as a standard, which should be called a plug-and-play for an image display apparatus. In accordance with the DDC standard, information on attributes of the image display apparatus is supplied by the image display apparatus to a host, which is an apparatus supplying an image signal, and the host automatically does setting adjusted to the characteristics of the image display apparatus. An example of the attributes of the image display apparatus is an optimum resolution.

In accordance with the DDC standard, information on characteristics of the image display apparatus is supplied by the image display apparatus to a host in the form of data having a format called an EDID (Extended Display Identification Data) format. Even with the power supply of the image display apparatus turned off, the host supplies power to the image display apparatus so that the image display apparatus is capable of transmitting the EDID data to the host. It is thus necessary to store the EDID data in a nonvolatile memory such as an EEPROM in order to prevent the EDID data from being lost even if the power supply of the image display apparatus is turned off.

In the past, an image output apparatus conforming to the DDC standard was computers only. The types of resolution of an RGB signals output by the computer are VGA (640×480), SVGA (800×600), XGA (1280×768), SXGA (1280×1024) and QXGA (2048×1536). Thus, for example, the EDID data stored in the nonvolatile memory of the conventional image display apparatus conforming to the DDC standard as data related to the resolution is a recommendation saying that SVGA is the optimum type of resolution for the RGB signals.

In addition, there has been proposed a display system in which, when an image output by a personal computer is displayed on a display unit, a technique of transmitting the data of the received image and the attributes of the image such as the resolution and frame rate of the image are identified by carrying out a format conversion process, and the data of the image is processed in accordance with the technique and the characteristics. If the technique of transmitting the data of the image received and the attributes of the image are not appropriate, the personal computer is requested to retransmit the EDID data. For more information on the proposed display system, refer to information sources such as paragraph [0041] and FIG. 1, which are included in Japanese Patent Laid-open No. 2001-265313. This document is taken as Patent Document 1.

SUMMARY OF THE INVENTION

A frame conversion process described in Patent Document 1 cited above is carried out to convert image data received from the personal computer into an image with a refresh rate higher than a frame rate adopted in an image display apparatus as the normal frame rate of 60 Hz. By outputting the image obtained as a result of the frame conversion process to an LCD panel of the display unit, the degree of blurring peculiar to a moving picture can conceivably be lowered.

In order to implement a process to convert image data received from the personal computer into an image with a high refresh rate by carrying out the frame conversion process in the image display apparatus, however, it is necessary to provide the image display apparatus with a buffer memory and an interpolation circuit for generating an interpolation frame by making use of the data of the input image.

In addition, in the frame conversion process carried out in the image display apparatus, it is necessary to save image data of frames leading ahead of and lagging behind an input image, insert data of an interpolation frame between frames of the saved image data and compute data of an image to be displayed. The computation process carried out in the image display apparatus causes a delay of the output image from the input image.

Image data output by the personal computer obtained as a result of executing an application program such a game played by the user carrying out interactive operations has a problem caused by a delay of a movement of an image appearing on a display screen from an input operation carried out by the user on an image output by the personal computer. The problem causes inconvenience that the image cannot be well used in the game.

Addressing the problems described above, inventors of the present invention have innovated an information display apparatus and an information display method both capable of smoothly displaying a moving image without requiring a special buffer memory, an interpolation circuit and an interpolation process, which are necessary for image conversion processing carried out in the image display apparatus, and without raising a problem caused by a delay of a movement of an image appearing on a display screen from an image output by a personal computer serving as the host of the image display apparatus.

In order to solve the above problems, in accordance with an embodiment of the present invention, there is provided an information display apparatus which may have a timing storage section configured to store timing data which shows at least an image supplied by the image supplying source with a predetermined timing; an image determination section for producing a result of determination as to whether or not the image supplied by the image supplying source is based on the timing data; and an output-path switching section for changing an output path of the image received from the image supplying source in order to supply the image received from the image supplying source to an image display section as it is without driving an image conversion section to carry out a conversion process on the image received from the image supplying source to convert the image received from the image supplying source into an output image compatible with the image display section if the determination result produced by the image determination section indicates that the image received from the image supplying source is based on the timing data.

As described above, the timing storage section may be used for storing at least timing data showing a predetermined timing with which an image supplied by the image supplying source is to be displayed, and the image determination section may produce a result of determination as to whether or not the image supplied by the image supplying source is based on the timing data.

Then, if the determination result produced by the image determination section indicates that the image received from the image supplying source is based on the timing data, the output-path switching section may change the output path of the image received from the image supplying source in order to supply the image received from the image supplying source to the image display section as it is without driving the image conversion section to carry out a conversion process on the image received from the image supplying source in order to convert the image received from the image supplying source into an output image compatible with the image display section.

Thus, the timing data stored in the timing storage section is timing data having a highest refresh rate at which an image is to be displayed on the image display section. If the timing data stored in the timing storage section is timing data for a plug-and-play for outputting a timing for a high refresh rate, by electrically connecting the image display apparatus to the image supplying source by a cable, the timing data can be supplied in advance from the image display apparatus to the image supplying source.

Thus, if the image supplying source provides the image display apparatus with an image, which has a high refresh rate and can be displayed on the image display section as it is without driving the image conversion section to carry out a conversion process on the image in order to convert the image into an output image compatible with the image display section, the image display apparatus may be capable of displaying a blurring-free output image at the high refresh rate on the image display section without requiring a special buffer memory and an interpolation circuit.

In addition, in accordance with another embodiment of the present invention, there is provided an information display method which may include driving an image supplying source to recognize an image display unit; reading out timing data from a memory of the image display unit as data to be used as a basis for displaying an image received from the image supplying source as an image having a predetermined timing required by the image supplying source; outputting the image having the predetermined timing required by the image supplying source to the image display unit; producing a result of determination as to whether or not the image supplied by the image supplying source is based on the timing data; and changing an output path of the image received from the image supplying source in order to supply the image received from the image supplying source to the image display unit as it is without carrying out a conversion process on the image received from the image supplying source to convert the image received from the image supplying source into an output image compatible with the image display unit if the result of the determination indicates that the image received from the image supplying source is based on the timing data.

As described above, first of all, the image supplying source may recognize the image display unit. Then, timing data may be read out from a memory of the image display unit as data to be used as a basis for displaying an image received from the image supplying source as an image with a predetermined timing required by the image supplying source. Subsequently, the image may be output with the predetermined timing required by the image supplying source to the image display unit.

Then, the image supplied by the image supplying source may be examined in order to produce a result of determination as to whether or not the image supplied by the image supplying source is based on the timing data. Finally, if the result of the determination indicates that the image supplied by the image supplying source is based on the timing data, the output path of the image may be changed in order to supply the image supplied by the image supplying source to the image display unit as it is without carrying out a conversion process on the image supplied by the image supplying source in order to convert the image supplied by the image supplying source into an output image compatible with the image display unit.

Thus, if the timing data stored in the memory of the image display unit is timing data having a highest refresh rate for showing an image on the image display unit, the timing data can be supplied in advance from the image display unit to the image supplying source.

At that time, by outputting an image received from the image supplying source as an image with a high refresh rate to the image display unit as it is without carrying out a conversion process on the image, the image display unit may be capable of displaying the image received from the image supplying source at the high refresh rate without carrying out special computation processing so as to lower the degree of blurring peculiar to a moving picture.

In accordance with the present invention, the image display apparatus may not require a buffer memory and an interpolation circuit. Thus, the image display unit may be capable of displaying the image at the high refresh rate with a low degree of blurring caused by the high refresh rate as blurring peculiar to a moving picture.

In addition, the image display apparatus may not need to carryout computation processing of an interpolation process to interpolate data stored in a buffer memory. It is thus possible to shorten the time it takes to generate an output image.

On top of that, by transferring timing data of an image to be displayed from the image display apparatus to the image supplying source, the image supplying source may automatically output the image with a timing rate based on the timing data to the image display apparatus. Thus, the image display apparatus may not require a buffer memory and an interpolation circuit.

DETAILED DESCRIPTION

By referring to diagrams, the following description concretely explains preferred embodiments each implementing a liquid-crystal display apparatus 2 provided by the present invention.

Figure 1:
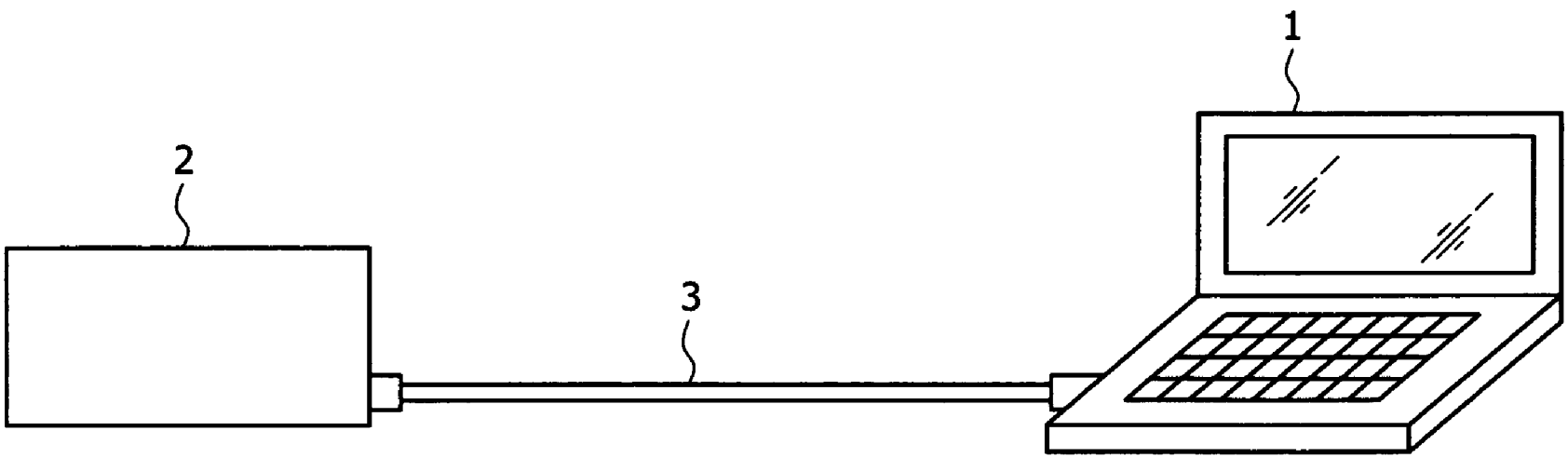
FIG. 1 is a diagram showing a liquid crystal display unit according to an embodiment of the present invention and a personal computer connected to the liquid crystal display unit.

FIG. 1 is a block diagram showing the liquid-crystal display apparatus 2 according to an embodiment of the present invention and a personal computer 1 connected to the liquid-crystal display apparatus 2 as an image supplying source for supplying an image to the liquid-crystal display apparatus 2. The liquid-crystal display apparatus 2 conforms to a DVI (Digital Visual Interface) standard, which is a standard for digital transmission of video signals.

The personal computer 1 also conforms to the DVI standard as well. The DVI connector of the liquid-crystal display apparatus 2 is connected to the DVI connector of the personal computer 1 by using a DVI cable 3 for connecting the personal computer 1 and the liquid-crystal display apparatus 2 to each other. It is to be noted that the DVI connector of the personal computer 1 is not shown in the figure.

The DVI standard requires that the DDC standard be adopted. Thus, a DVI connector has a DDC terminal for exchanging EDID data.

Figure 2:
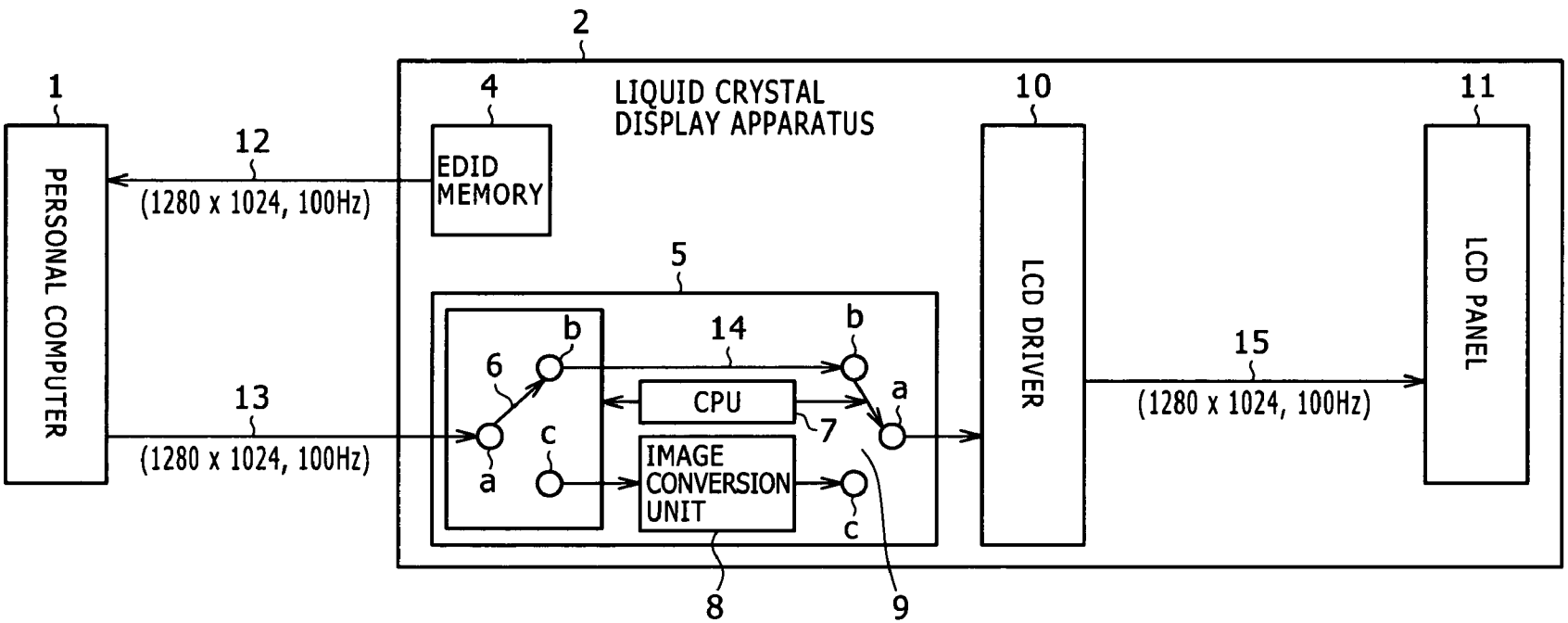
FIG. 2 is a block diagram showing a typical configuration of the liquid crystal display unit.

FIG. 2 is a diagram particularly showing a typical configuration of circuits employed in the liquid-crystal display apparatus 2 as circuits relevant to the embodiment of the present invention. As shown in the figure, the liquid-crystal display apparatus 2 employs a nonvolatile memory 4, which is a nonvolatile memory conforming to the EDID format. Typically, the nonvolatile memory 4 is an EEPROM conforming to the EDID format. At the manufacturing process, timing data is stored in advance in the nonvolatile memory 4 as data representing a predetermined timing with which data received from the personal computer 1 is to be displayed on an LCD (Liquid-Crystal Display) panel 11 employed in the liquid-crystal display apparatus 2 as an image display unit.

The timing data stored in advance in the nonvolatile memory 4 typically represents a recommended timing. For example, the timing data is high refresh timing data 12 including a resolution of 1280×1024 and a refresh frequency of 100 Hz, which is higher than the normal refresh rate of 60 Hz. In addition, the timing data also includes timing data such as a synch width, a front porch and a back porch, representing positions on the display screen of an image based on a video signal in one horizontal period.

The personal computer 1 connected to the liquid-crystal display apparatus 2 as an image supplying source typically retrieves the high refresh timing data 12 including the resolution of 1280×1024 and the high refresh frequency of 100 Hz from the liquid-crystal display apparatus 2, outputting high refresh timing image data 13 with a refresh timing specified in the high refresh timing data 12 as a timing corresponding to the resolution of 1280×1024 and the high refresh frequency of 100 Hz.

To be more specific, the personal computer 1 outputs the high refresh timing image data 13 to the scaler 5 employed in the liquid-crystal display apparatus 2. The scaler 5 employs an image conversion unit 8 for converting the frequency and resolution of image data in the liquid-crystal display apparatus 2. The scaler 5 also employs a discrimination switch 6 and an output switch 9. A CPU 7 also employed in the scaler 5 executes control to connect a movable contact point a of the discrimination switch 6 to a fixed contact point b or c of the discrimination switch 6. By the same token, the CPU 6 also executes control to connect a movable contact point a of the output switch 9 to a fixed contact point b or c of the output switch 9.

When the CPU 7 employed in the liquid-crystal display apparatus 2 recognizes the resolution and refresh frequency of the received high refresh timing image data 13 to be the resolution of 1280×1024 and the high refresh frequency of 100 Hz respectively, the CPU 7 executes control to connect the movable contact point a of the discrimination switch 6 to the fixed contact point b of the discrimination switch 6 and control to connect the movable contact point a of the output switch 9 to the fixed contact point b of the output switch 9.

Thus, the output switch 9 outputs the high refresh timing image data 13 to an LCD driver 10 employed in the liquid-crystal display apparatus 2 as it is without driving an image conversion unit 8 employed in the scaler 5 to scale the resolution and the high refresh frequency. That is to say, the output switch 9 outputs high refresh timing image data 14, which also has the resolution of 1280×1024 and the high refresh frequency of 100 Hz to the LCD driver 10.

The LCD driver 10 outputs a high refresh timing image driving signal 15 having the resolution of 1280×1024 and the high refresh frequency of 100 Hz to the LCD panel 11 employed in the liquid-crystal display apparatus 2. The LCD panel 11 then displays an image with a high refresh timing adopted as it is. At that time, the refresh rate is higher than the normal one. Thus, it is possible to display the image at the high refresh rate with an extremely low degree of blurring peculiar to a moving picture without carrying out an interpolation process.

When the personal computer 1 provides the liquid-crystal display apparatus 2 with image data generated by the personal computer 1 as data not compatible with the high refresh timing data 12 retrieved by the personal computer 1 from the liquid-crystal display apparatus 2, on the other hand, the image data supplied by the personal computer 1 to the liquid-crystal display apparatus 2 is regarded as data based on normal refresh timing data. In this case, the CPU 7 recognizes the resolution and refresh frequency of image data received from the personal computer 1 to be a resolution of 1024×768 and the normal refresh frequency of 60 Hz respectively, executing control to connect the movable contact point a of the discrimination switch 6 to the fixed contact point c of the discrimination switch 6 and control to connect the movable contact point a of the output switch 9 to the fixed contact point c of the output switch 9.

Thus, the output switch 9 outputs refresh timing image data obtained as a result of a process carried out by the image conversion unit 8 to scale the frequency and resolution of the image data received from the personal computer 1 to the LCD driver 10. The refresh timing image data output by the output switch 9 to the LCD driver 10 as image data proper for the liquid-crystal display apparatus 2 is image data having a resolution of 1280×1024 and the normal refresh frequency of 60 Hz.

Receiving the image data from the output switch 9, the LCD driver 10 supplies a refresh timing image driving signal 15 having the resolution of 1280×1024 and the normal refresh frequency of 60 Hz to the LCD panel 11 in order to display an image on the LCD panel 11 with this refresh timing.

Figure 3:
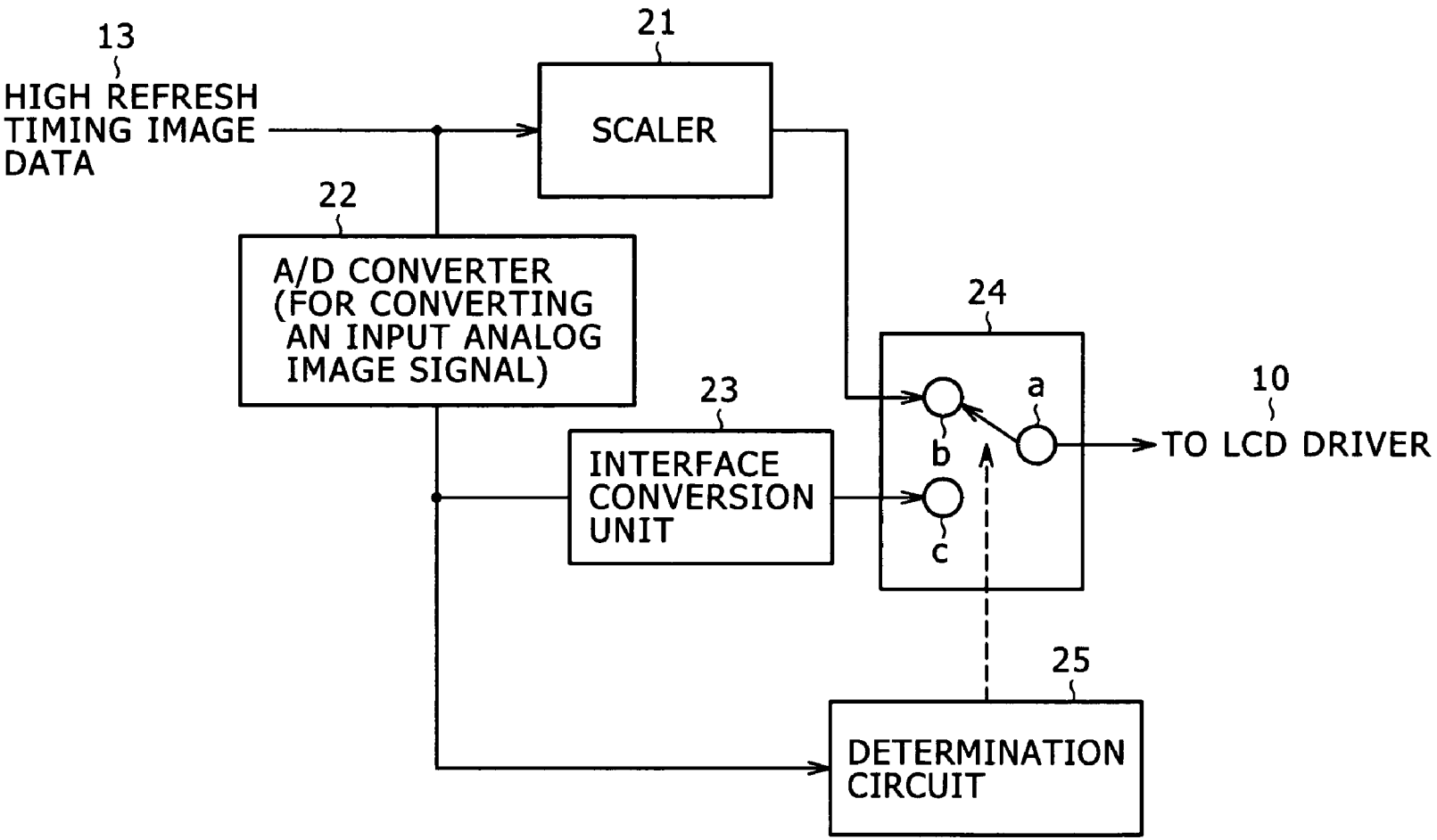
FIG. 3 is a block diagram showing another typical configuration of the liquid crystal display unit.

FIG. 3 is a block diagram showing another typical configuration of the liquid crystal display unit.

In the case of the liquid-crystal display apparatus 2 implemented by the embodiment shown in FIG. 2, the scaler 5 employs the discrimination switch 6 and the output switch 9, which are used to change the output path of image data received from the personal computer 1, in addition to the CPU 7 for controlling the output path. In the case of the other embodiment shown in FIG. 3 as an embodiment implementing the liquid crystal display unit, on the other hand, an output switch 24 and a discrimination circuit 25 for controlling the output path of image data are provided outside a scaler 21. Much like the embodiment shown in FIG. 2, also in the case of the other embodiment shown in FIG. 3, the liquid crystal display unit employs a nonvolatile memory 4 inside the unit and, as a premise, operates in the same way as the embodiment shown in FIG. 2.

In the case of other embodiment shown in FIG. 3, when the discrimination circuit 25 employed in the liquid crystal display unit recognizes the resolution and refresh frequency of the received recommended high refresh timing image data 13 to be the resolution of 1280×1024 and the high refresh frequency of 100 Hz respectively, the discrimination circuit 25 drives the output switch 24 to connect its movable contact point a to a fixed contact point c thereof.

Thus, without scaling the frequency and resolution of the high refresh timing image data in the scaler 21, the output switch 24 passes on the image data received from an A/D converter 22 by way of an interface conversion unit 23 with the resolution of 1280×1024 and the high refresh frequency of 100 Hz kept as they are to the LCD driver 10. The A/D converter 22 is a section only for converting the high refresh timing image data 13 received as an input analog signal into digital image data whereas the interface conversion unit 23 is a section only for converting the digital image data output by the A/D converter 22 into a parallel output suitable for the LCD driver 10 to be supplied to the fixed contact point c.

If the discrimination circuit 25 recognizes the resolution and refresh frequency of the refresh timing image data to be respectively the resolution of 1024×768 and the refresh frequency of 60 Hz, which are a resolution and frequency not recommended by the discrimination circuit 25, on the other hand, the discrimination circuit 25 drives the output switch 24 to connect its movable contact point a to a fixed contact point b thereof.

Thus, the output switch 24 provides the LCD driver 10 with image data output by the scaler 21 for carrying out a scaling process to scale the resolution and frequency of input image data as refresh timing image data having the resolution of 1280×1024 suitable for the liquid-crystal display apparatus 2 and the normal refresh frequency of 60 Hz.

Figure 4:
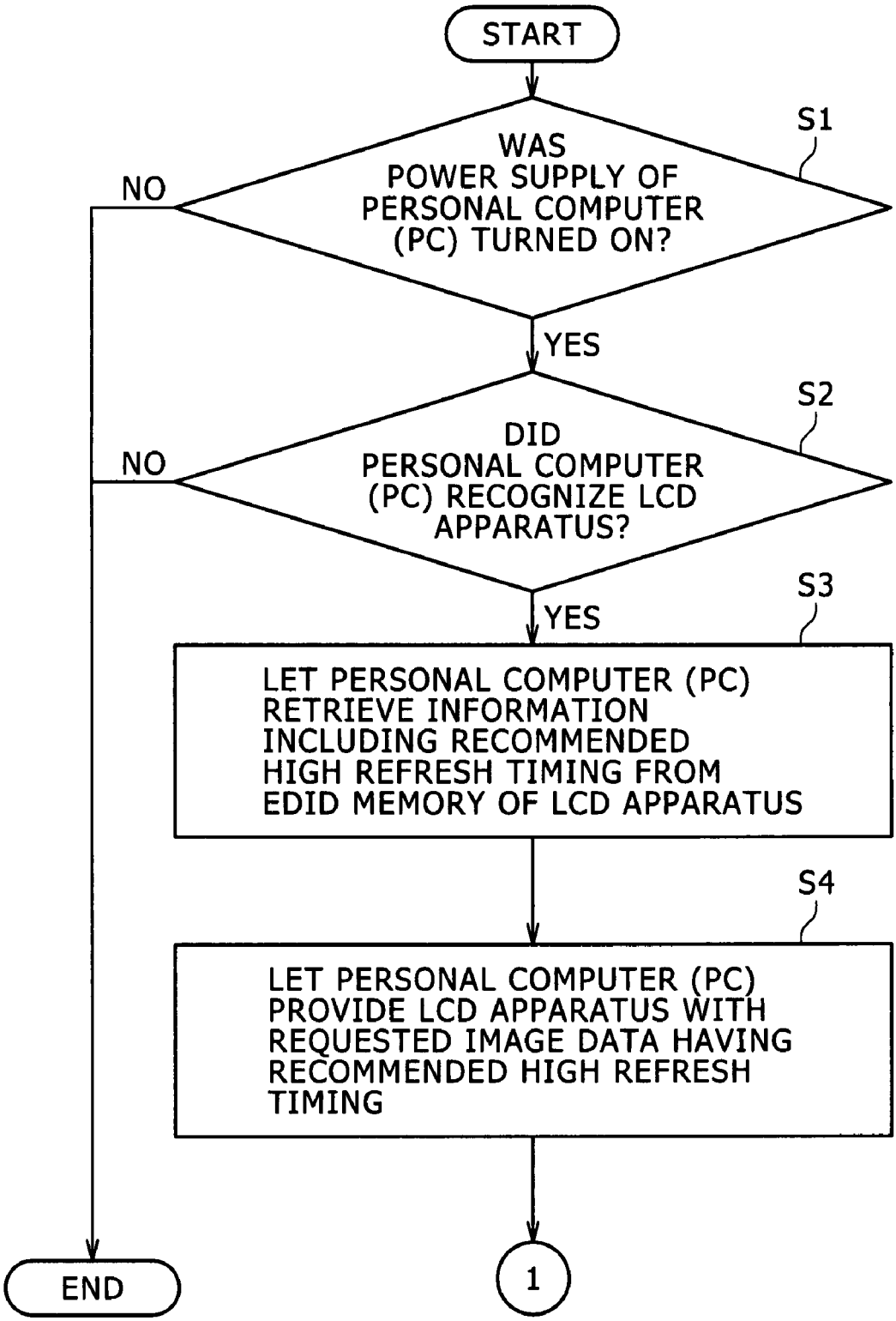
FIG. 4 shows a flowchart representing processing to mainly display recommended high refresh timing image data.
Figure 5:
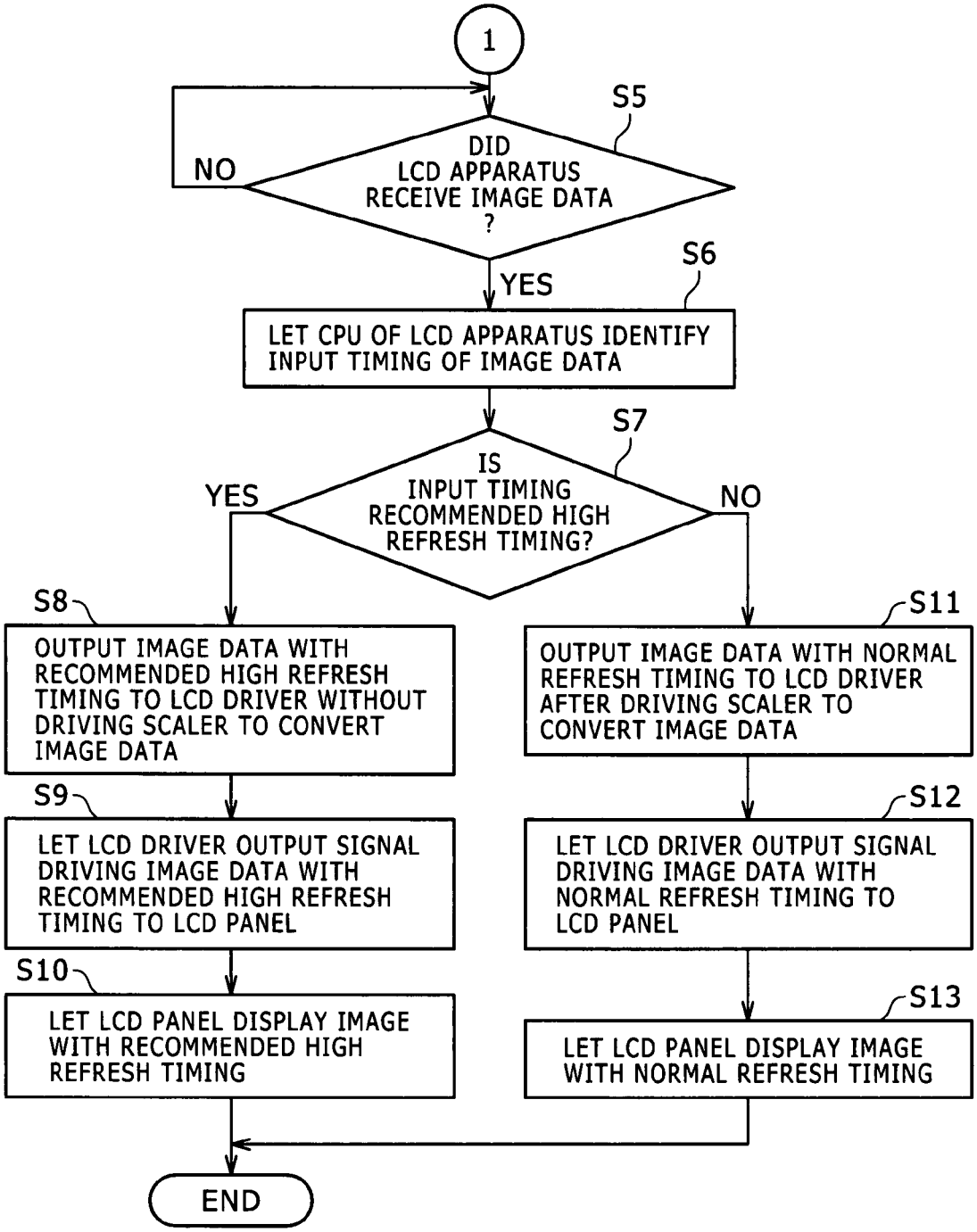
FIG. 5 shows the continuation of the flowchart shown in FIG. 4.

FIGS. 4 and 5 show a flowchart representing processing carried out by the CPU 7 to mainly make the recommended high refresh timing image data displayable on the LCD panel 11 as a result of transferring EDID data from the liquid-crystal display apparatus 2 to the personal computer 1. As shown in the figures, the flowchart of the processing begins with a step S1 at which the CPU 7 produces a result of determination as to whether or not the power supply of the personal computer 1 has been turned on.

If the determination result produced at the step S1 indicates that the power supply of the personal computer 1 has been turned on, the flow of the processing goes on to a step S2 at which the CPU 7 produces a result of determination as to whether or not the personal computer 1 has recognized the liquid-crystal display apparatus 2. If the determination result produced at the step S1 indicates that the power supply of the personal computer 1 has not been turned on and the determination result produced at the step S2 indicates that the personal computer 1 has not recognized the liquid-crystal display apparatus 2, the processing is ended.

If the determination result produced at the step S2 indicates that the personal computer 1 has recognized the liquid-crystal display apparatus 2, on the other hand, the flow of the processing goes on to a step S3 at which the personal computer 1 retrieves information including a recommended high refresh timing from the nonvolatile memory 4 employed in the liquid-crystal display apparatus 2. The CPU 7 recognizes the operation carried out by the personal computer 1 to read out the information including a recommended high refresh timing from the nonvolatile memory 4.

Then, at the next step S4, the personal computer 1 provides the liquid-crystal display apparatus 2 with requested image data having the recommended high refresh timing.

Subsequently, at the next step S5, the CPU 7 produces a result of determination as to whether or not the liquid-crystal display apparatus 2 has received the image data from the personal computer 1. If the determination result produced at the step S5 indicates that the liquid-crystal display apparatus 2 has received the image data from the personal computer 1, the flow of the processing goes on to a step S6 at which the CPU 7 identifies the input timing of the image data.

Then, at the next step S7, the CPU 7 produces a result of determination as to whether or not the input timing of the image data is the recommended high refresh timing. If the determination result produced at the step S7 indicates that the input timing of the image data is the recommended high refresh timing, the flow of the processing goes on to a step S8 at which the CPU 7 drives the output switch 9 to output the high refresh timing image data 13 to the LCD driver 10 employed in the liquid-crystal display apparatus 2 as it is without driving the image conversion unit 8 employed in the scaler 5 to scale the resolution and the high refresh frequency. That is to say, the output switch 9 outputs high refresh timing image data 14, which also has the resolution of 1280×1024 and the high refresh frequency of 100 Hz to the LCD driver 10.

Then, at the next step S9, the LCD driver 10 outputs a high refresh timing image driving signal 15 having the resolution of 1280×1024 and the high refresh frequency of 100 Hz to the LCD panel 11 employed in the liquid-crystal display apparatus 2, which then displays an image with the recommended high refresh timing adopted as it is at the following step S10.

If the determination result produced at the step S7 indicates that the input timing of the image data is not the recommended high refresh timing, on the other hand, the flow of the processing goes on to a step S11 at which the CPU 7 drives the output switch 9 to output refresh timing image data obtained as a result of a process carried out by the image conversion unit 8 to scale the frequency and resolution of the image data received from the personal computer 1 to the LCD driver 10. The refresh timing image data output by the output switch 9 to the LCD driver 10 as image data proper for the liquid-crystal display apparatus 2 is image data having a resolution of 1280×1024 and the normal refresh frequency of 60 Hz.

Receiving the image data from the output switch 9 at the step S10, the LCD driver 10 supplies a refresh timing image driving signal 15 having the resolution of 1280×1024 and the normal refresh frequency of 60 Hz to the LCD panel 11 at the next step S12.

Then, at the next step S13, the LCD panel 11 displays an image with this refresh timing.

In the embodiments described above, the personal computer 1 and the liquid-crystal display apparatus 2 are connected to each other by using the DVI cable 3. However, the scope of the present invention is by no means limited to these embodiments. For example, the present invention can be applied to a configuration in which an LCD panel 32 can be integrated with a personal computer 31 to form a single body as shown in FIG. 6.

Figure 6:
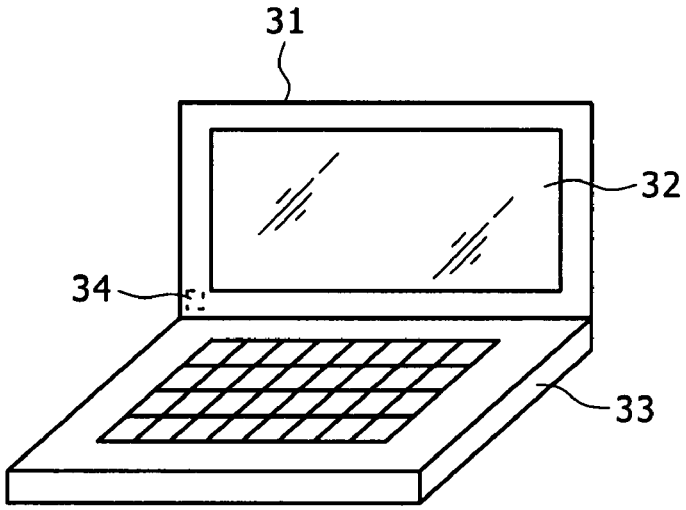
FIG. 6 is a diagram showing a typical personal computer employing an LCD panel integrated therein to form a single body in accordance with another embodiment of the present invention.

FIG. 6 is a diagram showing a typical personal computer 31 employing an LCD panel integrated therein to form a single body in accordance with another embodiment of the present invention. Thus, the personal computer 31 shown in FIG. 6 includes a main unit 33 serving as an image supplying source and an LCD panel 32, which has a refresh timing storage memory 34 for storing a recommended refresh timing.

Figure 7:
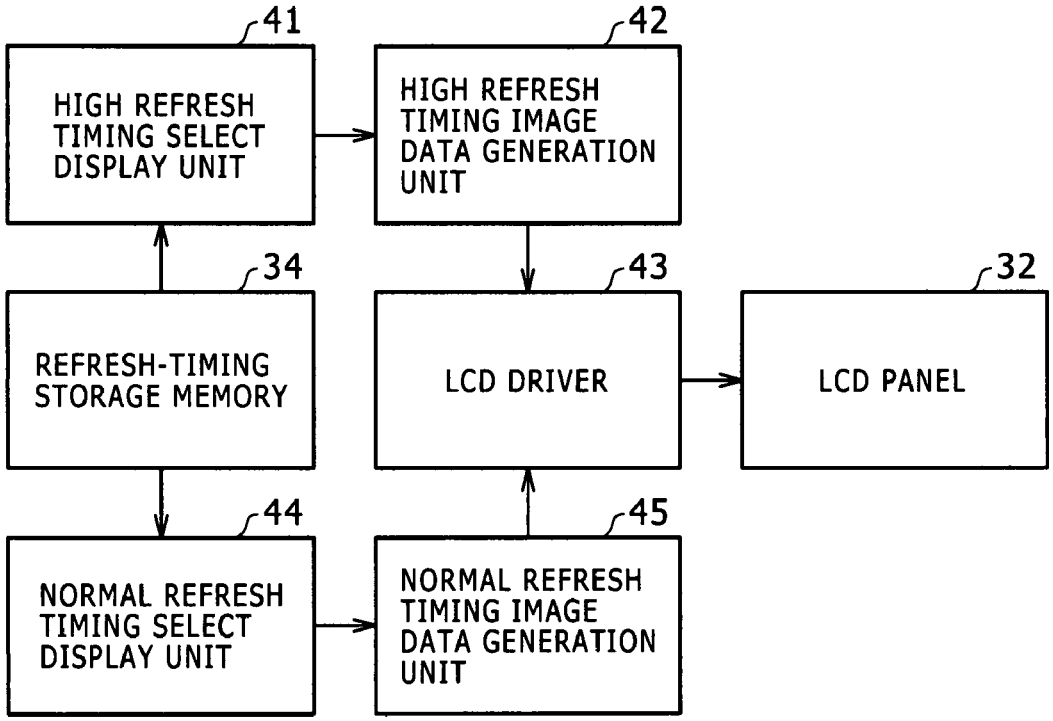
FIG. 7 is a block diagram the configuration of a refresh-timing generation system of the typical personal computer employing an LCD panel integrated therein to form a single body.

FIG. 7 is a block diagram showing the configuration of a refresh-timing generation system of the typical personal computer 31 employing the LCD panel 32 integrated therein to form a single body in accordance with an embodiment of the present invention. In the configuration of the refresh-timing generation system shown in FIG. 7, a process of selecting a high refresh timing is carried out by supplying the recommended refresh timing stored in the refresh timing storage memory 34 to a high refresh timing select display unit 41. The refresh-timing generation system is typically included in the LCD panel 32.

Then, the high refresh timing select display unit 41 supplies a high refresh timing select display signal to a high refresh timing image data generation unit 42 for generating high refresh timing image data on the basis of the high refresh timing select display signal.

The high refresh timing image data generation unit 42 supplies the high refresh timing image data to a LCD driver 43. Receiving the high refresh timing image data from the high refresh timing image data generation unit 42, the LCD driver 43 supplies a signal for driving high refresh timing image data to the LCD panel 32, which then displays the high refresh timing image data.

In a process of selecting a normal refresh timing, on the other hand, a normal refresh timing stored in the refresh timing storage memory 34 is supplied to a normal refresh timing image data generation unit 44.

Then, the normal refresh timing image data generation unit 44 supplies a normal refresh timing select display signal to a normal refresh timing image data generation unit 45 for generating normal refresh timing image data on the basis of the normal refresh timing select display signal.

The normal refresh timing image data generation unit 45 supplies the normal refresh timing image data to the LCD driver 43. Receiving the normal refresh timing image data from the normal refresh timing image data generation unit 45, the LCD driver 43 supplies a signal for driving normal refresh timing image data to the LCD panel 32, which then displays the high refresh timing image data.

Figure 10:
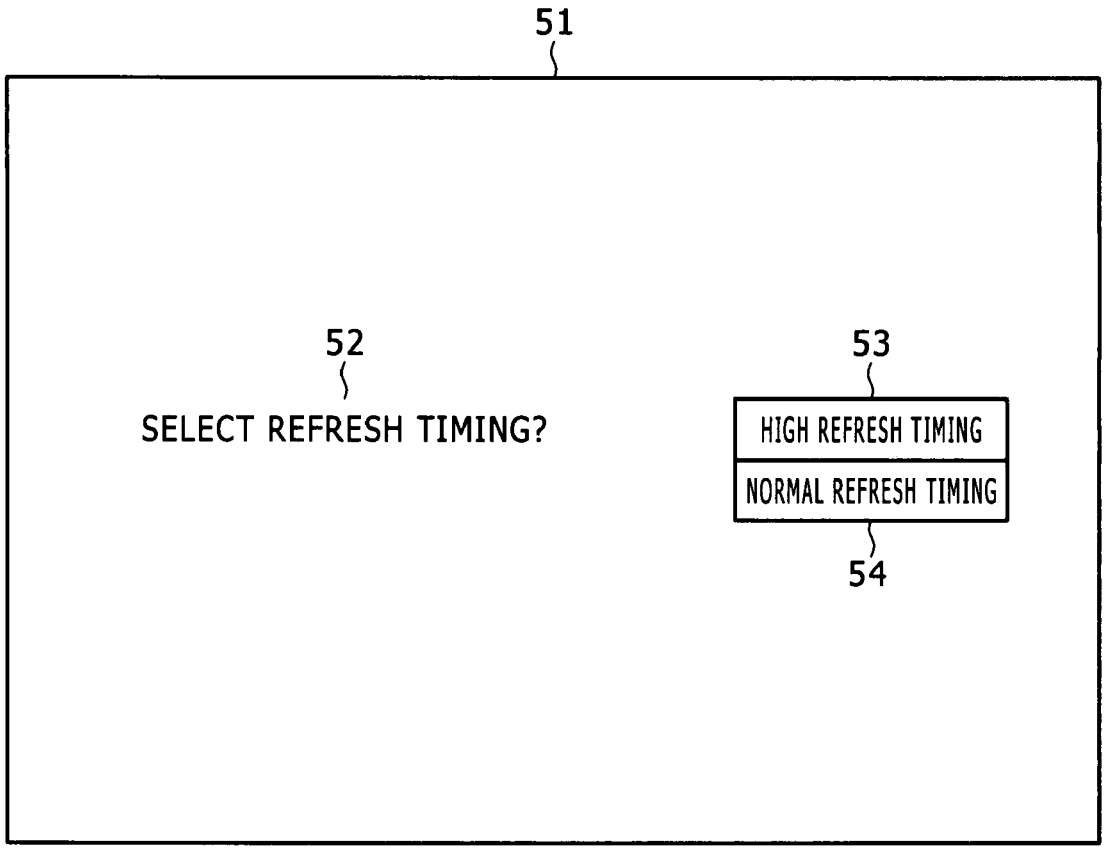
FIG. 10 is a diagram showing a menu screen for selecting a high refresh timing.

FIG. 10 is a diagram showing a menu screen 51 appearing on the LCD panel 32 as a screen for selecting a high refresh timing. As shown in FIG. 10, the menu screen 51 displays a refresh timing select message 52 as a query. The menu screen 51 also displays icons of a high refresh 53 and a normal refresh 54, which are each provided as a selectable response to the query. Typically, one of the icons representing the high refresh 53 and the normal refresh 54 is selected by operating a mouse. If the icon of the high refresh 53 is selected, the process of selecting the high refresh timing as described above is carried out. If the icon of the normal refresh 54 is selected, on the other hand, the process of selecting the normal refresh timing as described above is carried out.

Figure 8:
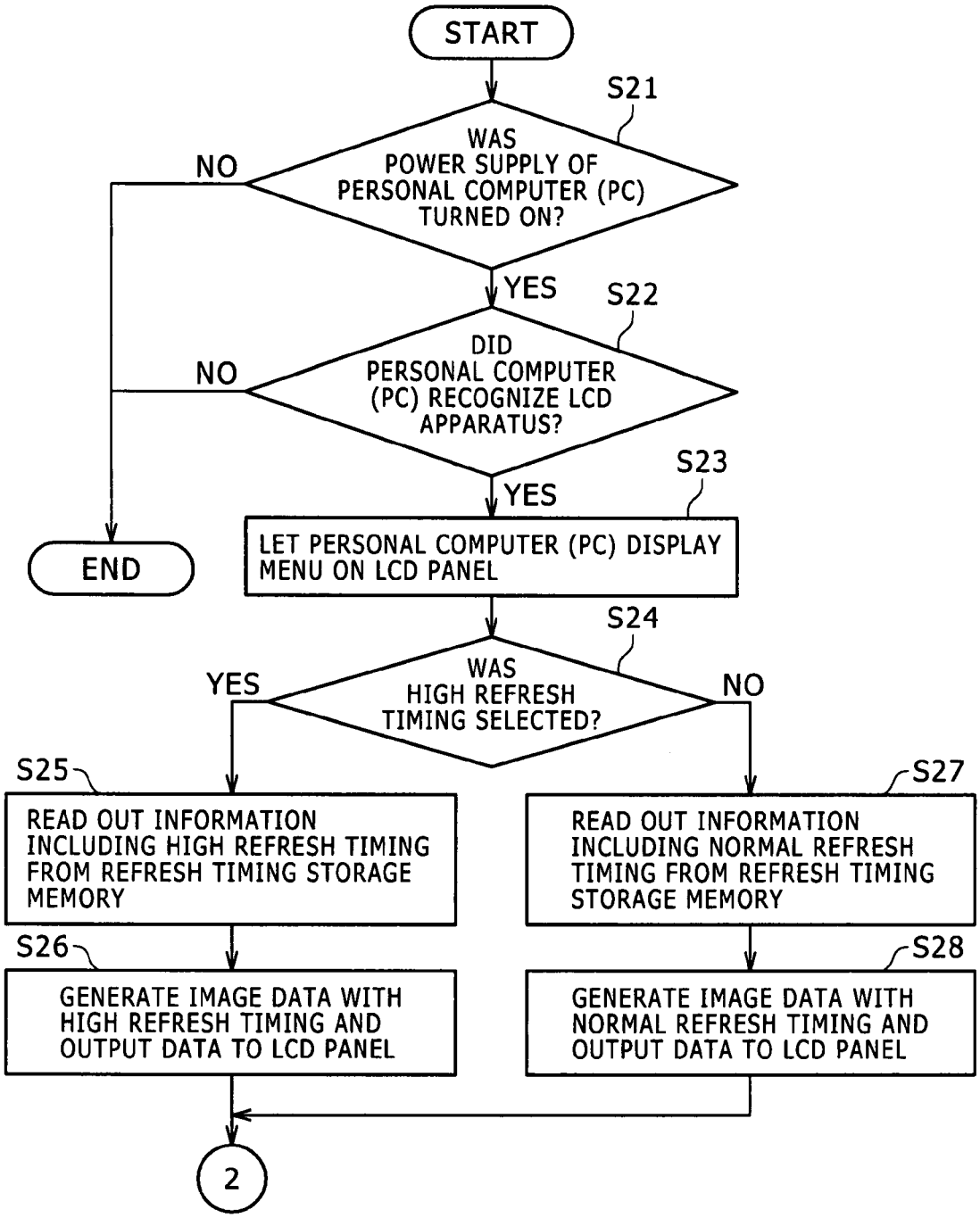
FIG. 8 shows a flowchart representing processing to mainly display recommended high refresh timing image data.
Figure 9:
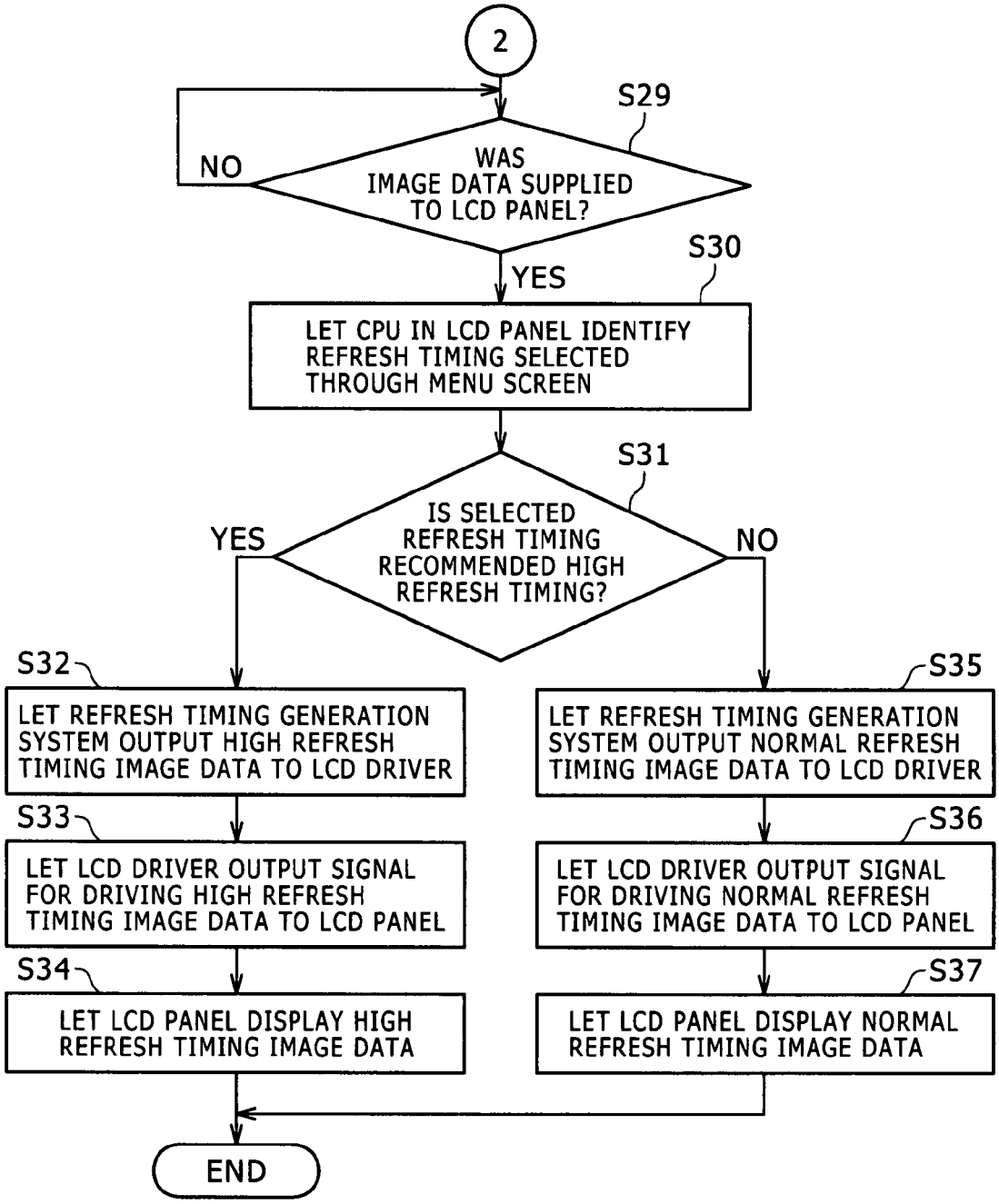
FIG. 9 shows the continuation of the flowchart shown in FIG. 8.

FIGS. 8 and 9 show a flowchart representing processing carried out mainly by a CPU employed in the refresh timing generation system in order to allow the LCD panel 32 and the main unit 33 to display the recommended high refresh timing image data. It is to be noted that this CPU is shown in none of the figures. As shown in FIGS. 8 and 9, the flowchart of the processing begins with a step S21 at which the CPU employed in the refresh timing generation system produces a result of determination as to whether or not the power supply of the personal computer 31 has been turned on.

If the determination result produced at the step S21 indicates that the power supply of the personal computer 31 has been turned on, the flow of the processing goes on to a step S22 at which the CPU employed in the refresh timing generation system produces a result of determination as to whether or not the main unit 33 employed in the personal computer 31 has recognized the LCD panel 32. If the determination result produced at the step S21 indicates that the power supply of the personal computer 31 has not been turned on or if the determination result produced at the step S22 indicates that the main unit 33 employed in the personal computer 31 has not recognized the LCD panel 32, the processing is ended.

If the determination result produced at the step S22 indicates that the main unit 33 employed in the personal computer 31 has recognized the LCD panel 32, on the other hand, the flow of the processing goes on to a step S23 at which the personal computer 31 displays the menu screen 51 on the LCD panel 32.

Then, at the next step S24, the CPU employed in the refresh timing generation system produces a result of determination as to whether or not the user has selected the high refresh timing through the menu screen 51.

If the determination result produced at the step S24 indicates that the user has selected the high refresh timing, the flow of the processing goes on to a step S25 at which the personal computer 31 reads out information including the recommended high refresh timing from the refresh timing storage memory 34 employed in the LCD panel 32.

Then, at the next step S26, the personal computer 31 outputs requested image data with the recommended high refresh timing to the LCD panel 32.

If the determination result produced at the step S24 indicates that the user has selected the normal refresh timing, on the other hand, the flow of the processing goes on to a step S27 at which the personal computer 31 reads out information including the normal refresh timing from the refresh timing storage memory 34 employed in the LCD panel 32.

Then, at the next step S28, the personal computer 31 outputs image data with the normal refresh timing to the LCD panel 32.

After the process carried out at the step S26 or S28 is completed, the flow of the processing goes on to a step S29 at which the CPU employed in the refresh timing generation system produces a result of determination as to whether or not image data has been supplied to the LCD panel 32. If the determination result produced at the step S29 indicates that image data has been supplied to the LCD panel 32, the flow of the processing goes on to a step S30 at which the CPU employed in the refresh timing generation system carries out a process to identify a refresh timing selected through the menu screen.

Then, at the next step S31, the CPU employed in the refresh timing generation system produces a result of determination as to whether or not the refresh timing selected through the menu screen is the recommended high refresh timing. If the determination result produced at the step S31 indicates that the refresh timing selected through the menu screen is the recommended high refresh timing, the flow of the processing goes on to a step S32 at which the CPU employed in the refresh timing generation system outputs high refresh timing image data generated by the high refresh timing image data generation unit 42 to the LCD driver 43.

Then, at the next step S33, the LCD driver 43 outputs a signal for driving high refresh timing image data to the LCD panel 32, which then displays the high refresh timing image data at the next step S34.

If the determination result produced at the step S31 indicates that the refresh timing selected through the menu screen is the normal high refresh timing, on the other hand, the flow of the processing goes on to a step S35 at which the CPU employed in the refresh timing generation system outputs normal refresh timing image data generated by the normal refresh timing image data generation unit 45 to the LCD driver 43.

Then, at the next step S36, the LCD driver 43 outputs a signal for driving normal refresh timing image data to the LCD panel 32, which then displays the normal refresh timing image data at the next step S37.

In addition, the liquid crystal display units according to the embodiments described above may employ an overdrive circuit for reducing the rise time of the LCD panel. On top of that, the liquid crystal display units according to the embodiments described above may be provided with a function for lowering the degree of blurring typical to a moving picture. An example of the function is a blinking backlight function for erasing a backlight of the LCD panel in the course of a refresh operation. With such an overdrive circuit and such a function, the effects of the present invention can be further improved.

The scope of the present invention is by no means limited to the embodiments described above. That is to say, it is needless to say that a variety of configurations can be provided as configurations not deviating from the domain of essentials of the present invention.

The invention claimed is:

1. An information display apparatus for displaying an image received from an image supplying source on an image display section, said information display apparatus comprising:

a timing storage section configured to store timing data associated with an image having a predetermined timing and supplied by said image supplying source;

an image determination section operable to determine whether or not said received image is based on said stored timing data; and an output-path switching section including a first switch, a second switch and an image conversion unit, the image conversion unit being coupled between the first switch and second switch to allow the switches to selectively bypass the image conversion unit so as to change an output path of said received image in order to supply said received image to said image display section as it is without converting said received image into an output image compatible with said image display section if said determination section indicates that said received image is based on said stored timing data.

2. The image display apparatus according to claim 1 wherein, if said received image is determined to be an image based on timing data different from said timing data stored in said timing storage section, said output-path switching section changes said output path of said received image so that said image display section receives an output image generated by an image conversion section as a result of a conversion process carried out by said image conversion section on said received image to convert said received image into said output image, which is compatible with said image display section.

3. The image display apparatus according to claim 1 wherein, by electrically connecting said image display apparatus to said image supplying source by a cable, said timing data stored in said timing storage section can be supplied to said image supplying source.

4. The image display apparatus according to claim 1 wherein:

said image display apparatus is integrated with said image supplying source to form a single body; and the timing data of said image can be selected through a menu displayed on said image display section.

5. A method for displaying an image on an image display unit, the method comprising:

driving an image supplying source to recognize said image display unit;

reading out timing data from a memory of said image display unit as data to be used as a basis for displaying an image received from said image supplying source, said received image having a predetermined timing required by said image supplying source;

outputting said received image having. said predetermined timing to said image display unit;

determining whether said received image is based on said timing data; and bypassing an image conversion unit coupled between a discrimination switch and an output switch to selectively switch an output path of said received image to supply said received image to said image display unit as it is without converting said received image into an output image compatible with said image display unit if said result of said determination indicates that said received image is based on said timing data.

6. The image display method according to claim 5 further comprising:

changing, if said received image is determined to be an image based on timing data different from said timing data stored in said memory of said image display unit, said output path of said received image so that said image display unit receives an output image generated by conversion of said received image, said output image being compatible with said image display unit.

* * * * *